US010596591B2

(12) United States Patent
Lee, III

(10) Patent No.: US 10,596,591 B2
(45) Date of Patent: Mar. 24, 2020

(54) MATERIAL DISPENSING SYSTEM AND METHOD

(71) Applicant: Red Devil, Inc., Tulsa, OK (US)

(72) Inventor: George L. Lee, III, Tulsa, OK (US)

(73) Assignee: Red Devil Inc., Tulsa, OK (US)

( * ) Notice: Subject to any disclaimer, the term of this patent is extended or adjusted under 35 U.S.C. 154(b) by 0 days.

(21) Appl. No.: 15/398,193

(22) Filed: Jan. 4, 2017

(65) Prior Publication Data

US 2018/0185874 A1 Jul. 5, 2018

(51) Int. Cl.

| | |
|---|---|
| ***B05C 17/005*** | (2006.01) |
| ***B05C 17/01*** | (2006.01) |
| *B67B 7/00* | (2006.01) |
| *B67B 7/86* | (2006.01) |

(52) U.S. Cl.

CPC .. *B05C 17/00586* (2013.01); *B05C 17/00583* (2013.01); *B05C 17/0123* (2013.01); *B67B 7/26* (2013.01); *B67B 7/28* (2013.01)

(58) Field of Classification Search

CPC ..... B05C 17/00583; B05C 17/00586; B05C 17/0123; B65D 51/2835; B65D 51/2814; B65D 51/285; B65D 51/2821; B65D 51/2828; B67B 7/26; B67B 7/28

See application file for complete search history.

(56) References Cited

U.S. PATENT DOCUMENTS 1,965,271 A * 7/1934 Wharton ..... F16N 37/02 222/390
5,161,715 A * 11/1992 Giannuzzi ..... B05C 17/00506 222/105
5,170,911 A * 12/1992 Della Riva ..... B65D 77/065 222/105
5,301,835 A * 4/1994 Fulks ..... B05C 17/00583 222/105
5,358,501 A * 10/1994 Meyer ..... A61J 1/2089 604/403
5,368,206 A * 11/1994 Sandrin ..... B05C 17/00583 222/326
5,704,518 A * 1/1998 Vanmoor ..... B05C 17/00576 222/327
5,855,298 A * 1/1999 Teetsel, III ..... B67B 7/26 222/81
6,234,348 B1 * 5/2001 Okamura ..... B05C 17/00516 222/1

(Continued)

FOREIGN PATENT DOCUMENTS

DE 102007060382 * 6/2009 ..... B05C 17/00503

*Primary Examiner* — David P Angwin
*Assistant Examiner* — Bob Zadeh
(74) *Attorney, Agent, or Firm* — David Guerra

(57) ABSTRACT

The present invention is a material dispensing system for controllably dispensing material from a packaging such as a chub pack. The system can include a housing capable of receiving the packaging, a cover pivotably connected to the housing, at least one nozzle tip, and at least one piercing projection capable of piercing the packaging. A packaging compression assembly can be used to compress the packaging toward the piercing projection so that the piercing projection pierces the packaging and allows the material in the packaging to be dispensed from the nozzle tip. A locking slide can be included to secure the cover in a closed position.

21 Claims, 4 Drawing Sheets

(56) References Cited

U.S. PATENT DOCUMENTS

| | | | | |
|---|---|---|---|---|
| 6,564,970 | B1 * | 5/2003 | Walch | B05C 17/00516 222/327 |
| 7,086,431 | B2 * | 8/2006 | D'Antonio | B65B 3/003 141/285 |
| 2006/0091032 | A1 * | 5/2006 | Tsai | A45C 13/28 206/373 |
| 2007/0038149 | A1 * | 2/2007 | Calasso | A61B 5/1411 600/583 |
| 2008/0023495 | A1 * | 1/2008 | Takayama | B05C 17/00503 222/391 |
| 2008/0058863 | A1 * | 3/2008 | Quintero | A61B 17/00491 606/214 |
| 2012/0180688 | A1 * | 7/2012 | Padgett | F42B 5/313 102/466 |
| 2012/0203194 | A1 * | 8/2012 | Cederschiold | A61M 5/162 604/408 |
| 2013/0270293 | A1 * | 10/2013 | Dresser | B65D 5/748 222/83 |
| 2015/0267679 | A1 * | 9/2015 | Canal Vila | F03D 1/0641 416/236 R |
| 2019/0168252 | A1 * | 6/2019 | Springhorn | B05C 17/00513 |

* cited by examiner

MATERIAL DISPENSING SYSTEM AND METHOD

BACKGROUND OF THE INVENTION

Field of the Invention

The present invention relates to a material dispensing system and method for use in connection with controllably dispensing material from a chub pack and more specifically to methods and apparatuses related to hand-held caulking guns that can pierce a chub pack.

Description of the Prior Art

Material dispensing systems are desirable for providing an ergonomic hand-held device controllably dispensing a material with a desired bead size and shape.

Hand-held material dispensing devices, such as caulking guns, are well known in the art and generally rely on the action of a piston to push caulk material out of a caulk tube. The motion of the piston is induced by the advancement of a piston rod in the direction of the caulk tube, with the piston rod being advanced in the direction of travel by the operator's squeezing of a trigger.

These known devices are designed to receive and carry a disposable caulk tube. The housing of these caulking guns and the trigger are generally formed of stamped metal plate for manufacturing economy. The caulk tube generally includes a cylindrical tube featuring a sliding piston, and a nozzle tip, with material stored inside the tube. The caulk tube is commonly more expensive to manufacture than a chub pack because of the different structural elements. While a chub pack is considerably less expensive and easier to manufacture since it is a type of container formed by a tube of flexible packaging material.

While the above-described devices fulfill their respective, particular objectives and requirements, the aforementioned patents do not describe a material dispensing system that allows controllably dispensing material from a chub pack.

Therefore, a need exists for a new and improved material dispensing system that can be used for controllably dispensing material from a chub pack. In this regard, the present invention substantially fulfills this need. In this respect, the material dispensing system according to the present invention substantially departs from the conventional concepts and designs of the prior art, and in doing so provide an apparatus primarily developed for the purpose of controllably dispensing material from a chub pack.

SUMMARY OF THE INVENTION

In view of the foregoing disadvantages inherent in the known types of caulking guns now present in the prior art, the present invention provides an improved material dispensing system, and overcomes the above-mentioned disadvantages and drawbacks of the prior art. As such, the general purpose of the present invention, which will be described subsequently in greater detail, is to provide a new and improved material dispensing system and method which has all the advantages of the prior art mentioned heretofore and many novel features that result in a material dispensing system which is not anticipated, rendered obvious, suggested, or even implied by the prior art, either alone or in any combination thereof.

To attain this, the present invention essentially comprises a material dispensing system including a housing, at least one nozzle tip, at least one piercing projection, and a packaging compression assembly. The housing can have a configuration capable of receiving a packaging containing a material therein. The piercing projection can have a configuration capable of piercing a first end of the packaging and allowing the material in the packaging to be dispensed from the nozzle tip. The packaging compression assembly can have a configuration capable of compressing the packaging toward the nozzle tip.

There has thus been outlined, rather broadly, features of the invention in order that the detailed description thereof that follows may be better understood and in order that the present contribution to the art may be better appreciated.

The nozzle tip can be removably receivable in the housing with a portion of the nozzle tip being receivable through an opening defined through a first end of the housing. The nozzle tip can include the piercing projection.

The nozzle tip can further include a receiving end, and a dispensing end. The receiving end can have a configuration capable of receiving the first end of the packaging so that the piercing projection is capable of piercing the first end of the packaging and allowing the material in the packaging to travel to the dispensing end. The dispensing end can have a configuration capable of being received through the opening of the first end of the housing.

The piercing projection can include a piercing end, and an interior side defining at least one channel along a longitudinal axis of the piercing projection. The channel can be in fluid communication with a hollow interior of the dispensing end. The piercing projection can further include an exterior side angled from a longitudinal axis of the nozzle tip, and wherein the interior side is parallel with the longitudinal axis of the nozzle tip.

The receiving end of the nozzle tip can further include one or more radially arranged internal ribs each having at least an arcuate portion.

The piercing projection can extend into an interior of the receiving end in a direction from a terminus of the internal ribs. The piercing projection can be a plurality of radially arranged piercing projections.

The cover can further include at least one cover rib being lateral to a longitudinal axis of the cover, and at least one cover spar being along the longitudinal axis of the cover. The main housing can include at least one housing rib being lateral to a longitudinal axis of the main housing, and at least one housing spar being along the longitudinal axis of the main housing.

The cover can still further include a release member including at least one tab capable of engaging with a tab opening defined in a wall of the housing. The release member can have a configuration capable of moving the tab out of engagement with the tab opening to hold the cover in the closed position or release the cover so as to be opened.

The packaging compression assembly can include a piston slidable received in the housing, a piston rod connected to the piston, and a piston rod advancement assembly. The piston can have a configuration capable of contacting a second end of the packaging. The piston rod advancement assembly can have a configuration capable of advancing the piston rod toward the second end of the packaging.

The invention may also include at least one locking slide slidable associated with a cover rail extending from a side of the cover and a housing rail extending from a side of the housing. The locking slide, the cover rail and the housing rail can have a configuration capable of retaining the cover in the closed position.

There are, of course, additional features of the invention that will be described hereinafter and which will form the subject matter of the claims attached.

Numerous objects, features and advantages of the present invention will be readily apparent to those of ordinary skill in the art upon a reading of the following detailed description, but nonetheless illustrative, embodiments of the present invention when taken in conjunction with the accompanying drawings.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved material dispensing system that has all of the advantages of the prior art caulking guns and none of the disadvantages.

It is another object of the present invention to provide a new and improved material dispensing system that may be easily and efficiently manufactured and marketed.

An even further object of the present invention is to provide a new and improved material dispensing system that has a low cost of manufacture with regard to both materials and labor, and which accordingly is then susceptible of low prices of sale to the consuming public, thereby making such material dispensing system economically available to the buying public.

Still another object of the present invention is to provide a new material dispensing system that provides in the apparatuses and methods of the prior art some of the advantages thereof, while simultaneously overcoming some of the disadvantages normally associated therewith.

Even still another object of the present invention is to provide a material dispensing system for controllably dispensing material from a chub pack. This allows for the controlled dispensing of material from the chub pack using an interchangeable nozzle tip featuring piercing projections that pierce the chub pack thereby allowing the material to be dispensed from the dispensing end.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
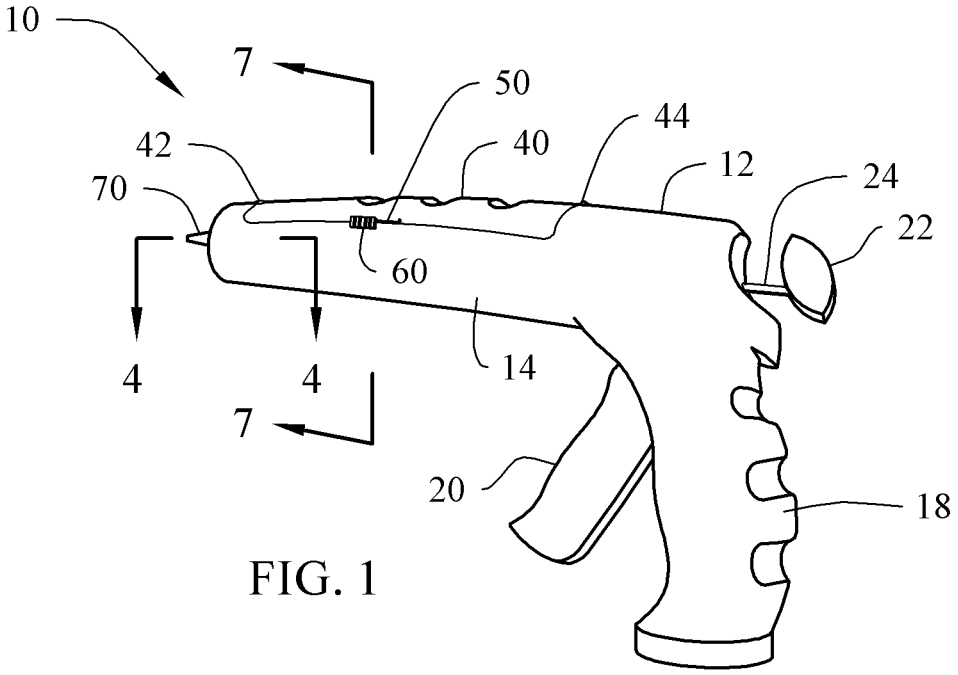
FIG. 1 is a rear-right perspective view of an embodiment of the material dispensing system constructed in accordance with the principles of the present invention, with the phantom lines depicting environmental structure and forming no part of the claimed invention.

Referring now to the drawings, and particularly to FIGS. 1-8, an embodiment of the material dispensing system of the present invention is shown and generally designated by the reference numeral 10.

In FIG. 1, a new and improved material dispensing system 10 of the present invention for controllably dispensing material from a packaging such as a chub pack is illustrated and will be described. More particularly, the material dispensing system 10 can have a dispensing unit 12, a cover 40 pivotably connected to the dispensing unit 12 via a hinge 42, and a packaging compression assembly capable of compressing the packaging toward a nozzle tip 70.

For exemplary purposes, the dispensing unit 12 can have a configuration similar to a gun featuring a main housing 14, a hand grip 18, a trigger 20, a piston grip 22, and a piston rod 24. It can be appreciated that the main housing 14 can be in the form without the hand grip 18, the trigger 20, the piston grip 22 or the piston rod 24. The main housing 14, the hand grip 18 and the trigger 20 can be made of, but not limited to, plastic, metal, composite, an alloy or any combination thereof. The dispensing unit 12 can be a single molded unit or can be made of separable and attachable sections secured together by, but not limited to, adhesive, welding, fasteners, tabs, locks, clips or other securing means.

The main housing 14 or the hand grip 18 can include a recess defined therein which features a configuration capable of receiving a side of the piston grip 22 so as to produce a smooth and flush transition therebetween when the piston grip 22 is received in the recess.

Figure 2:
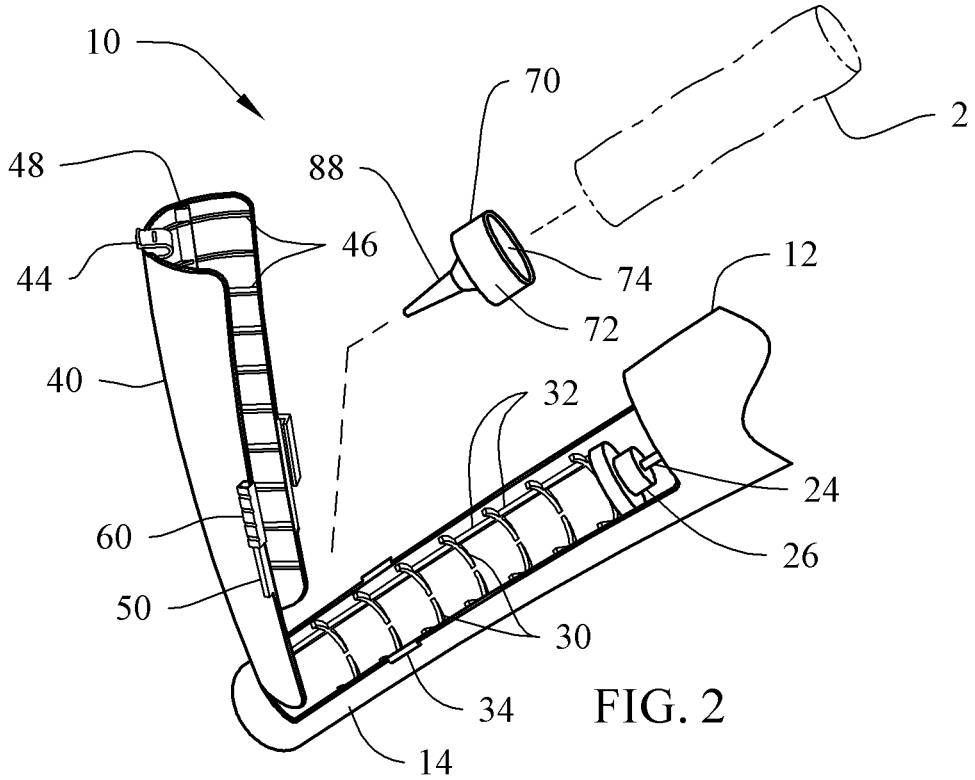
FIG. 2 is a top-right perspective view of the material dispensing system with the cover in the open position, and the nozzle tip and chub pack exploded.
Figure 3:
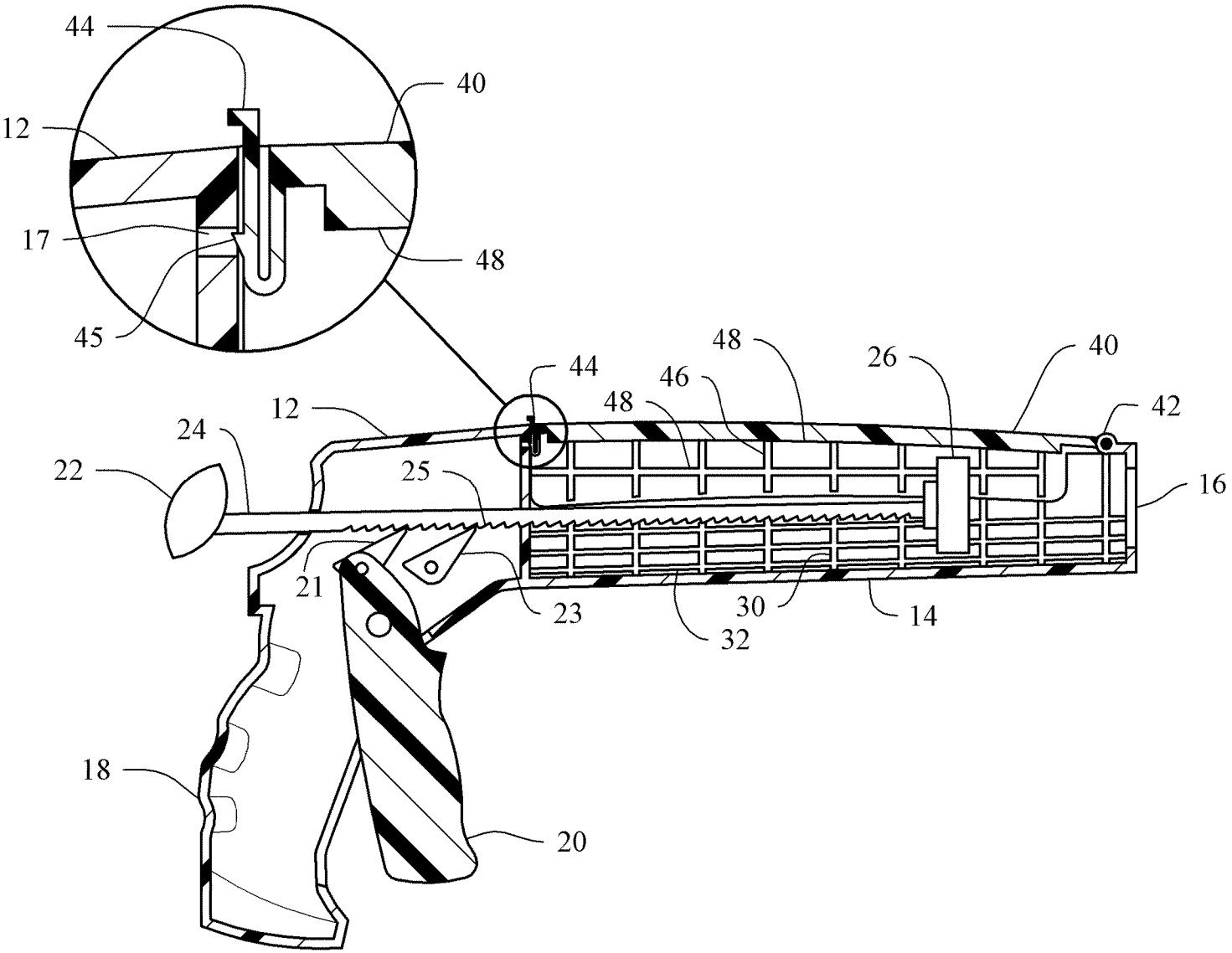
FIG. 3 is a cross-sectional view of the material dispensing system, with an enlarged section of the cover release member.

With reference to FIGS. 2 and 3, the main housing 14 can include a nozzle tip receiving end featuring an opening 16 having a configuration capable of receiving a dispensing end 88 of the nozzle tip 70 therethrough. The main housing 14 further defines an interior space having a configuration capable of receiving a packaging such as a chub pack 2 therein. The nozzle tip 70 can have a configuration capable of receiving an end portion of the chub pack 2. It can be appreciated that the nozzle tip 70 can be integrally formed with an end of the main housing 14, thereby creating a single main housing and nozzle tip unit.

The main housing 14 further includes an internal skeletal framework including one or more lateral housing ribs 30, and one or more longitudinal housing spars 32. The housing ribs 30 are in spaced apart relationship with each other, and extend into the interior space of the main housing 14. The housing ribs 30 can have an arcuate interior edge of a constant or varying curvature.

The piston rod 24 is connected to a piston 26 that is slidably receivable in the interior space of the main housing 14. The trigger 20, when operated by a user, can advance the piston rod 24 which thus advances the piston 26 along a longitudinal axis of the main housing 14 and interior of the housing ribs 30 and housing spars 32.

As best illustrated in FIG. 3, it can be appreciated that the trigger 20 is pivotable with the dispensing unit 12 so as to operate a piston rod advancing assembly. The piston rod advancing assembly can include a ratchet pawl 21 pivotably associated with an end portion of the trigger 20. The ratchet pawl 21 can be biased so as to pivot a ratchet end into and out of engagement with ratchet teeth 25 formed in a side of the piston rod 24. A locking pawl 23 can be included which is biased so as to pivot a locking end of the locking pawl 23 into and out of engagement with the ratchet teeth 25. The piston rod 24 can be rotated so as to engage or disengage the ratchet teeth 25 with the ratchet pawl 21 and/or the locking pawl 23. The trigger 20 can be biased so that an end opposite the ratchet pawl 21 is forced away from the hand grip.

It can be appreciated that a gear system, a motor system, an air bladder system or a tongue and roller system can be used in lieu of the above described ratcheting assembly.

In use, it can be appreciated that a user can squeeze the trigger 20, which pushes the ratchet end of the ratchet pawl 21 into engagement with one of the ratchet teeth 25. Further squeezing of the trigger 20 would advance the piston rod 24 toward the opening 16. Advancement of the piston rod 24 provides a ratcheting action between the ratchet teeth 25 and the locking pawl 23, which has a configuration capable of allowing the piston rod 24 to advance toward the opening 16 while preventing retraction of the piston rod 24 unless the ratchet teeth 25 are rotated out of engagement with the ratchet pawl 21 and locking pawl 23. Release of the trigger 20 will move the ratchet pawl 21 in an opposite direct of advancement for further advancing of the piston rod 24.

The cover 40 further includes an internal skeletal framework including one or more lateral cover ribs 46, and one or more longitudinal cover spars 48. The cover ribs 46 are in spaced apart relationship with each other, and extend into an interior space of defined by the cover 40. The cover ribs 46 can have an arcuate interior edge of a constant or varying curvature.

The cover 40 can further include a lifting or release member 44 having a configuration capable of being engaged by a user to disengage a tab 45 from a tab opening 17 defined in a back wall of the main housing 14. The release member 44 can be a biasing U-shaped member extending from an end of the cover 40, with the biasing force pushing the tab 45 into engagement with the tab opening 17 when the cover 40 is in the closed position, as best illustrated in the enlarged section of FIG. 3. The tab 45 can include an angled surface to assist in closing of the cover 40, and a ledge for engaging with the tab opening 17. The ledge has a configuration capable of securing the cover 40 in the closed position.

The release member 44 is capable of being moved so that the tab 45 is disengaged from the tab opening 17, thereby allowing the cover 40 to be opened gaining access to the interior space of the main housing 14. Lifting the cover 40 by way of the release member 44 pivots the cover 40 away from the main housing 14 via the hinge 42 that is associated with an end of the cover 40 opposite the release member 44.

A locking slide 60 is slidable associated with a cover rail 50 on one or both sides of the cover 40. The locking slide 60 has a configuration capable of slidably receiving a housing rail 34 extending from the main housing 14 in a locked position. In the locked position, the locking slide 60 receives a portion of both the cover rail 50 and the housing rail 34 so as to prevent the cover 40 from pivoting away from the main housing 14. The locking slide 60 can slide away from the housing rail 34 in an un-locked position so that the cover 40 can freely pivot away from the main housing 14.

It can be appreciated that a user could insert an end of the chub pack 2 into the opening 74 of the nozzle tip 70, then insert both the nozzle tip 70 and chub pack 2 into the interior space of the main housing 14 so that the dispensing end 88 of the nozzle tip 70 extend from the opening 16 of the main housing 14.

Figure 4:
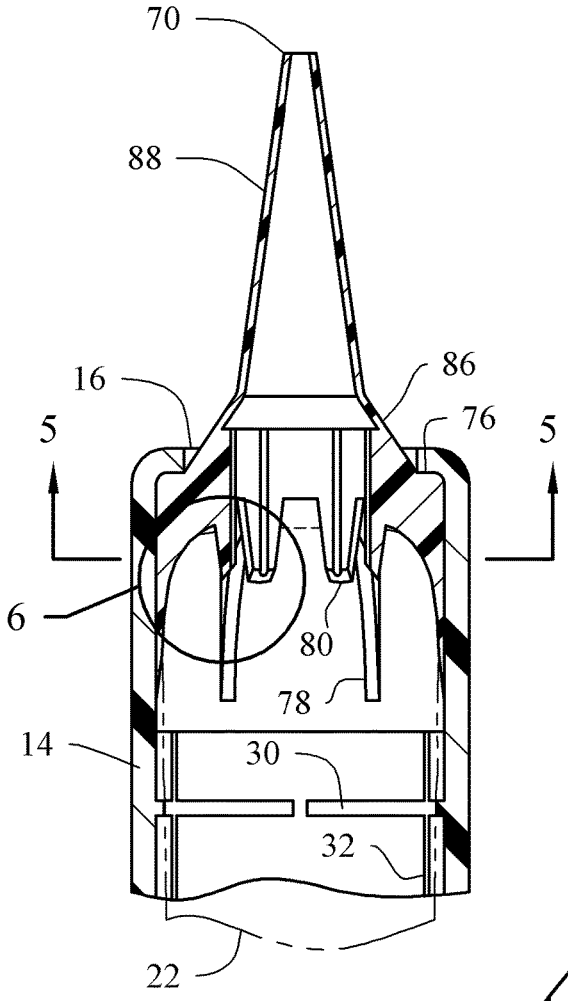
FIG. 4 is a cross-sectional view of the nozzle tip assembled in the dispensing unit taken along line 4-4 in FIG. 1.
Figure 5:
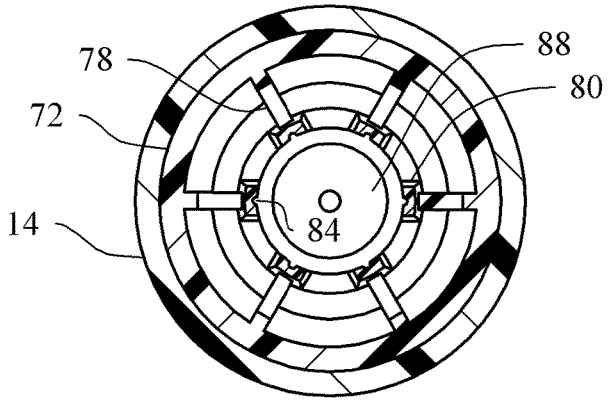
FIG. 5 is a cross-sectional view of the nozzle tip taken along line 5-5 in FIG. 4.
Figure 6:
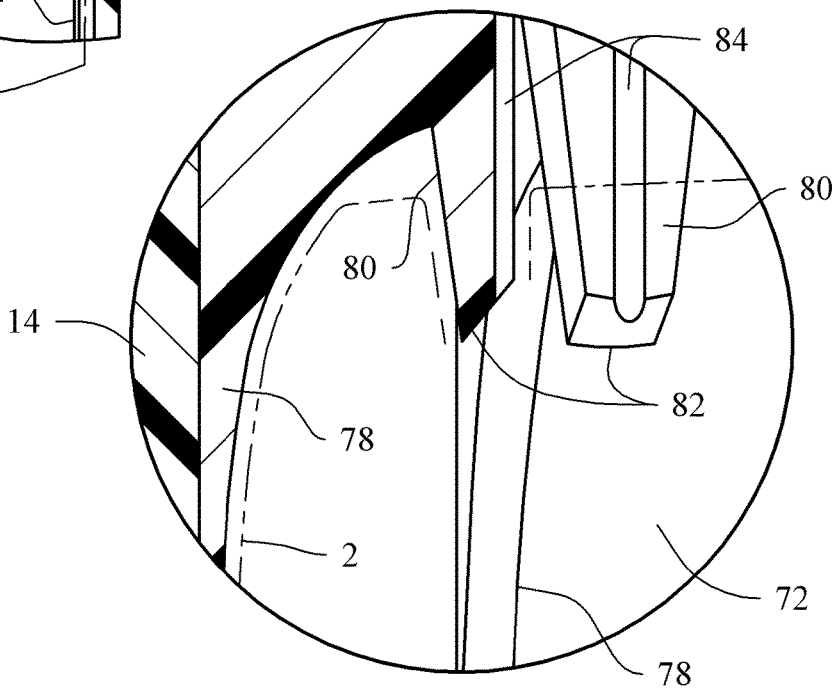
FIG. 6 is an enlarged cross-sectional view of the nozzle tip piercing the chub pack taken from section 6 in FIG. 4.

With reference to FIGS. 4-6, the dispensing end 88 of the nozzle tip 70 is received through the opening 16 of the main housing 14. The nozzle tip 70 includes a receiving end 72 defining an opening 74, and a ledge 76. The opening 74 has a configuration capable of receiving an end of the chub pack 2. The ledge 76 is located opposite the opening 74, and has a configuration capable of abutting against an edge of the main housing 14 that defines the opening 16. The ledge 76 prevents the nozzle tip 70 from being pushed through and out the opening 16.

A conical transition section 86 can extend away from the ledge 76 in a converging direction, and the dispensing end 88 can extend from the transition section 86 in a conically converging direction. The receiving end 72, transition section 86 and the dispensing end 88 all have a hollow interior. It can be appreciated that the dispensing end 88 can feature a closed distal end, which allows a user to cut off a section of the dispensing end 88 to form an opened dispensing end. The open dispensing end can be of any size determined by the location of the cut along the conically shaped dispensing end 88.

The receiving end 72 can include one or more radially arranged internal ribs 78, and one or more radially arranged piercing projections 80, as best illustrated in FIGS. 4 and 5. The internal ribs 78 extend into the interior of the receiving end 72 and have a generally arcuate or elliptical configuration capable of receiving and supporting an end portion of the chub pack 2. The internal ribs 78 can further provide structural support for the receiving end 72, and can further assist in guiding the end of the chub pack 2 toward the piercing projections 80.

It can be appreciated that the piercing projections 80 can be integrally formed with the main housing 14 or with a nozzle tip 70 that is integrally formed with the main housing 14.

As best illustrated in FIG. 6, the piercing projections 80 can extend into the interior of the receiving end 72 in a direction from a terminus of the internal ribs 78 toward the opening 74. The piercing projections 80 can include a piercing end 82, an exterior side angled from a longitudinal axis of the nozzle tip 70, and an interior side parallel with the longitudinal axis of the nozzle tip 70. The piercing end 82 can be angled to create an edge having a configuration capable of piercing the chub pack 2 when sufficient pressure is applied between them.

The piercing projections 80 can further include at least one channel 84 defined along a longitudinal axis of the interior side of the piercing projections 80. The channel 84 of each piercing projections 80 is in communication with the hollow interior of the nozzle tip 70. Once the chub pack 2 is punctured by the piercing projections 80, the piercing projections 80 are inserted/received into the interior of the chub pack 2 so that any material in the chub pack 2 is allowed to flow through the channel 84 and into hollow interior of the nozzle tip 70, and then into the dispensing end 88.

It can be appreciated that after the chub pack 2 is inserted into the receiving end 72, the nozzle tip 70 and/or the chub pack 2 can be rotated so that the piercing projections 80 puncture the chub pack 2 and consequently remove a section of the chub pack 2 punctured by the piercing projections 80. It can further be appreciated that the nozzle tip 70 can be of different shapes and sizes, and that it can be provided as a kit including multiple nozzle tips with dispensing ends of different sizes, shapes, lengths and/or configurations.

Figure 7:
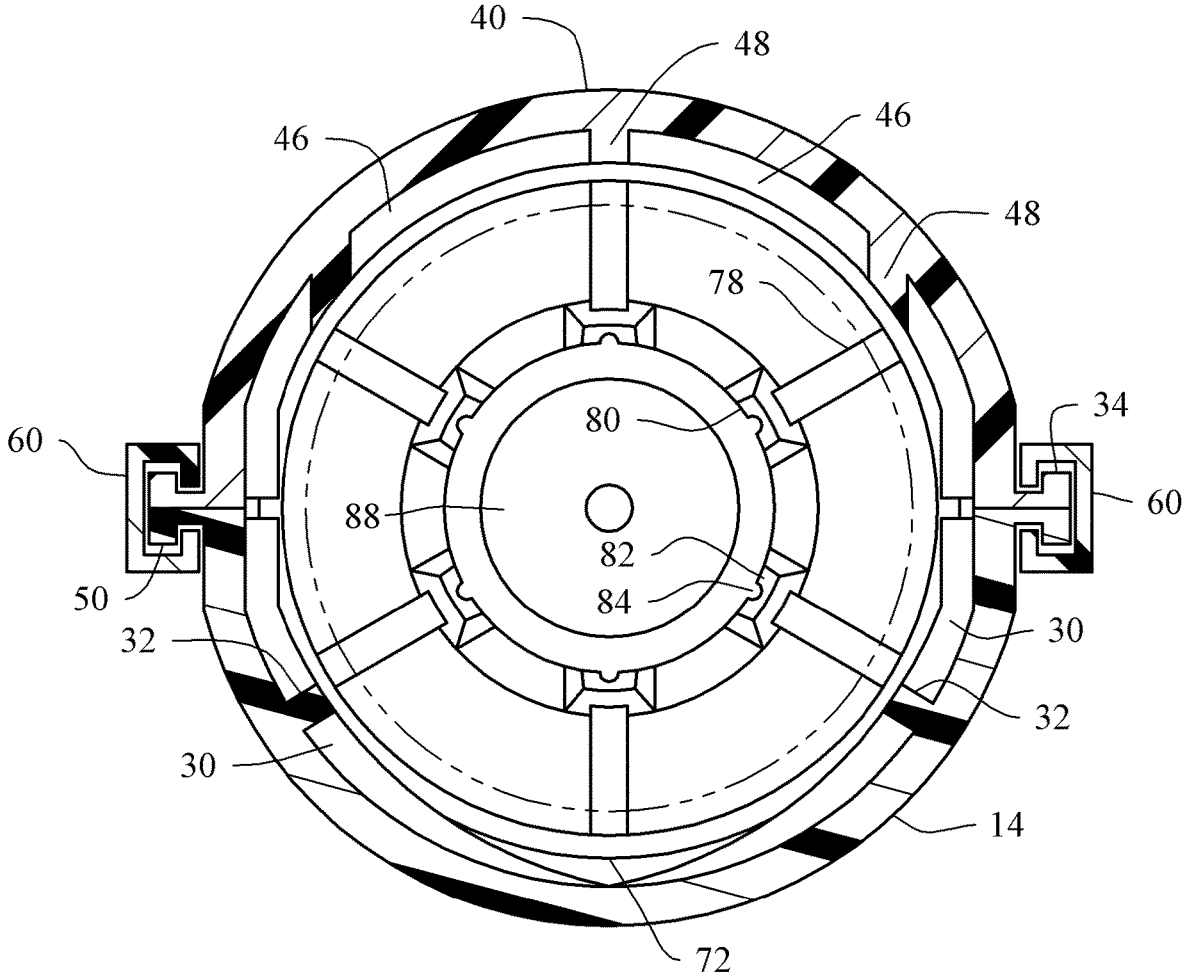
FIG. 7 is a cross-sectional view of the gun housing, the cover and the locking tab taken along line 7-7 in FIG. 1.
Figure 8:
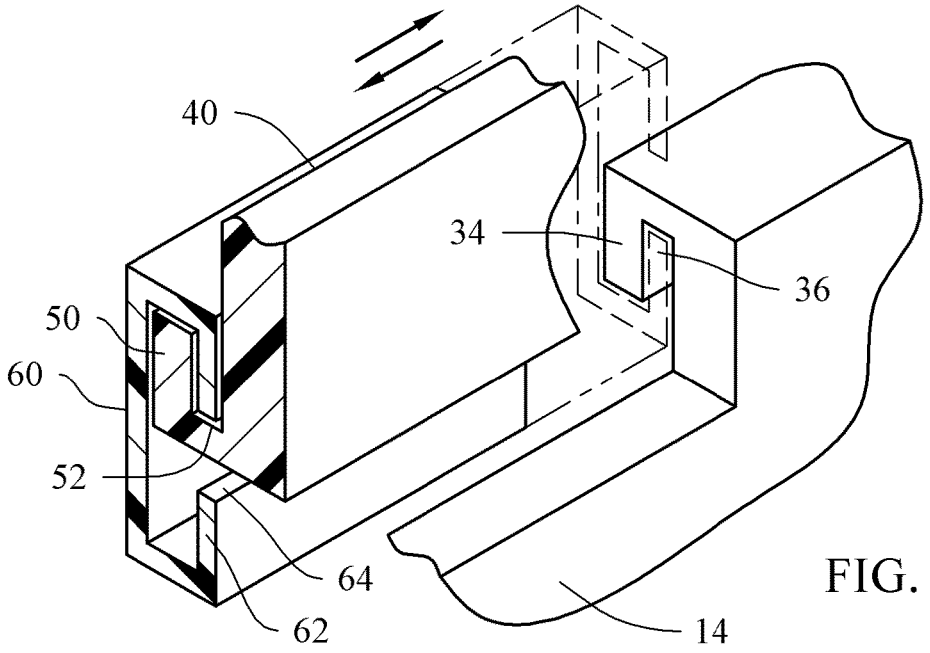
FIG. 8 is a cross-sectional perspective view of the locking tab.

With reference to FIGS. 6 and 7, the housing rail 34 can be a flanged edge offset from a side of the main housing 14 to define a housing notch 36 therebetween. The cover rail 50 can be a flanged edge offset from a side of the cover 40 to define a cover notch 52 therebetween, with the flanged edge of the cover rail 50 extending in a direction opposite the housing flanged edge when the cover 40 is in the closed position. The locking slide 60 generally has a C-channel configuration with flanged sides 62 extending toward each other to define a slot 64 therebetween. The C-channel configuration of the locking slide 60 is capable of receiving the housing flanged edge and the cover flanged edge so that the locking slide 60 can slide along both the housing rail 34 and the cover rail 50 when the cover 40 is in the closed position. The housing notch 36 and the cover notch 52 have a configuration capable of slidably receiving the flanged sides 62 of the locking slide 60, respectively.

The cover rail 50 can further include stop edges located at both ends of the cover rail 50, with the stop edges having a configuration capable of preventing the locking slide 60 from being removed from the cover rail 50.

The locking slide 60, the housing rail 34 and the cover rail 50 each have a length. The length of the housing rail 34 is less than the length of the cover rail 50 by at least a distance of the length of the locking slide 60. This is to allow the locking slide 60 to slide out past the housing rail 34 so that the cover 40 can be opened.

Alternatively, it can be appreciated that the length of the housing rail 34 and the length of the cover rail 50 can be switched so that the locking slide 60 is positioned on the housing rail 34, with the stop edges associated with the housing rail 34.

It can be appreciated that the material dispensing system 10 of the present invention can include draw back system (not shown) to ensure bead flow or flow of the material from the chub pack 2 ceases when the trigger 20 is disengaged. The draw back system can have a configuration capable of drawing back of pressure to avoid unwanted flow of material out the nozzle tip 70. The draw back system can include, but not limited to: a biasing assembly which is capable of pushing back against a part of the packaging compression assembly or against the chub pack 2; a retraction assembly which is capable of retracting at least a portion of the packaging compression assembly or the chub pack 2; or a nozzle tip moving assembly which is capable of moving the nozzle tip 70 away from the chub pack 2.

Currently, most ratchet systems will maintain a level of pressure on the chub pack 2 despite while the user is not using the trigger causing spillage. The draw back system could prevent this unwanted pressure against the chub pack thereby preventing spillage of material.

It can now be understood that the material dispensing system 10 of the present invention can be used to dispense a material, such as but not limited, caulk, adhesive, sealant, paste, cement and the like, from a chub pack 2. In exemplary use, a user can install a first end of the chub pack 2 into the opening 74 of the nozzle tip 70. With the piston 26 fully retracted and the cover 40 lifted in an open position, the assembled nozzle tip 70 and chub pack 2 can then be inserted into the interior space of the main housing 14 so that the dispensing end 88 of the nozzle tip 70 is received through the opening 16 of the main housing 14.

It can be appreciated that the nozzle tip 70 can be inserted into the interior space of the main housing 14 first, and after which the chub pack 2 can be inserted into the interior space of the main housing 14 so that the first end of the chub pack 2 is received through the opening 74 of the nozzle tip 70.

With the nozzle tip 70 and chub pack 2 installed in the interior space of the main housing 14, the user can then close the cover 40 so that the cover rail 50 is adjacent the housing rail 34. When the cover 40 is in the closed position, the locking slide 60 can then be slid along the housing rail 34 and the cover rail 50 so that the cover 40 is locked in the closed position and prevented from being pivoted away from the main housing 14.

The user can then operate the trigger 20 to advance the piston rod 24 which advances the piston 26 toward a second end of the chub pack 2. The advancement of the piston 26 pushes the first end of the chub pack 2 against the piercing projections 80 so that the piercing end 82 punctures through the first end of the chub pack 2, thereby opening a passage between the interior of the chub pack 2 and the hollowing interior of the nozzle tip 70.

Continued advancement of the piston 26 against the second end of the chub pack 2 could expand the sidewalls of the chub pack 2, which would consequently be contained by the housing ribs 30, the housing spars 32, the cover ribs 46 and the cover spars 48. This continued advancement of the piston 26 can force the material out of the chub pack 2 and through the channel 84 of the piercing projections 80. The material can then be forced through the hollow interior of the nozzle tip 70 and dispensed out an opening defined or cut in the dispensing end 88.

It can be appreciated that when the locking slide 60 is slid over both the housing rail 34 and the cover rail 50, the locking slide 60 can secure the cover 40 in the closed position and resist the forces acting on the cover 40 by an expanding chub pack 2.

The chub pack 2 can be removed and replaced by griping the piston grip 22 and retracting the piston 26 away from the chub pack 2. The user can then slide the locking slide 60 away from and past the housing rail 34, thereby unlocking the cover 40. The cover 40 can then be pivoted and/or lifted away from the main housing 14 with assistance from the release member 44. After which, the chub pack 2 can be removed, with or without the nozzle tip 70.

While embodiments of the material dispensing system have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material may be used instead of the above-described. And although controllably dispensing material from a chub pack have been described, it should be appreciated that the material dispensing system herein described is also suitable for dispensing any material stored in a packaging or container by piercing the packaging using advancing pressure supplied by a moving piston.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A material dispensing system comprising:

a housing having a configuration capable of receiving a packaging containing a material therein;

at least one nozzle tip associated with said housing, said nozzle tip including a receiving end, and a dispensing end;

at least one piercing projection having a configuration capable of piercing the packaging and allowing the material in the packaging to be dispensed from said nozzle tip, said piercing projection including a piercing end, an exterior side, and an interior side defining at least one channel in said interior side and along a longitudinal axis of said piercing projection, said channel being in fluid communication with a hollow interior of said dispensing end; and a packaging compression assembly having a configuration capable of compressing the packaging toward said piercing projection, wherein said receiving end of said nozzle tip including an annular wall parallel with a longitudinal axis of said nozzle tip, said annular wall including a plurality of radially arranged internal ribs extending out therefrom and located between said annular wall and said exterior side of said piercing projection.

2. The material dispensing system of claim 1, wherein said nozzle tip is removably receivable in said housing with a portion of said nozzle tip being receivable through an opening defined through a first end of said housing, said nozzle tip includes said piercing projection.

3. The material dispensing system of claim 2, wherein said receiving end having a configuration capable of receiving a first end of the packaging so that said piercing projection is capable of piercing the first end of the packaging and allowing the material in the packaging to travel to said dispensing end, said dispensing end having a configuration capable of being received through said opening of said first end of said housing.

4. The material dispensing system of claim 3, wherein said internal ribs each having at least an arcuate portion terminating at said exterior side of said piercing projection.

5. The material dispensing system of claim 4, wherein said piercing projection extends into an interior of said receiving end in a direction from a terminus of said internal ribs.

6. The material dispensing system of claim 1, wherein said exterior is side angled along an entire length thereof in relation to a longitudinal axis of said nozzle tip, said exterior side is opposite of said interior side, and wherein said interior side is parallel with said longitudinal axis of said nozzle tip.

7. The material dispensing system of claim 1, wherein said piercing projection is a plurality of radially arranged piercing projections.

8. The material dispensing system of claim 1 further comprising a cover pivotably connected with said housing, said cover having a configuration capable of covering an opened section of said housing when in a closed position.

9. The material dispensing system of claim 8, wherein said cover includes at least one cover rib and at least one cover spar.

10. The material dispensing system of claim 9, wherein said cover rib being lateral to a longitudinal axis of said cover, and said cover spar being along said longitudinal axis of said cover.

11. The material dispensing system of claim 9, wherein said cover rib and said cover spar extend into an interior of said cover, and wherein at least one of said cover rib and said cover spar has a configuration capable of contacting the packaging.

12. The material dispensing system of claim 8, wherein said cover further includes a release member including at least one tab, and wherein said housing further includes a wall defining a tab opening having a configuration capable of receiving said tab, said release member having a configuration capable of moving said tab out of engagement with said tab opening.

13. The material dispensing system of claim 8, wherein said housing further includes a hand grip, and said housing defines an internal space having a configuration capable of receiving the packaging.

14. The material dispensing system of claim 13, wherein said housing further includes at least one housing rib and at least one housing spar, and wherein at least one of said housing rib and said housing spar has a configuration capable of contacting the packaging.

15. The material dispensing system of claim 14, wherein said housing rib being lateral to a longitudinal axis of said housing, said housing spar being along said longitudinal axis of said housing.

16. The material dispensing system of claim 13, wherein said packaging compression assembly comprising:

a piston slidable received in said housing;

a piston rod connected to said piston, said piston having a configuration capable of contacting a second end of the packaging; and a piston rod advancement assembly having a configuration capable of advancing said piston rod toward the second end of the packaging.

17. The material dispensing system of claim 16, wherein said piston rod advancement assembly further includes a trigger pivotably associated with said hand grip, and at least one pawl engageable with at least one ratchet tooth of said piston rod.

18. The material dispensing system of claim 8 further comprising at least one locking slide slidable associated with a cover rail extending from a side of said cover and a housing rail extending from a side of said housing, wherein said locking slide, said cover rail and said housing rail have a configuration capable of retaining said cover in the closed position.

19. The material dispensing system of claim 18, wherein at least one of said cover rail and said housing rail has a length less than the other allowing said cover to pivot away from said housing in an open position.

20. The material dispensing system of claim 1, wherein said receiving end is configured so that the material from the packaging is allowed to flow into said nozzle tip only from an area defined by said interior side of said piercing projections.

21. The material dispensing system of claim 1, wherein said receiving end is configured to receive an end of the packaging prior to being pierced by said piercing end of said piercing projections.

* * * * *